US005967435A

United States Patent [19]

Lanham

[11] Patent Number: 5,967,435

[45] Date of Patent: Oct. 19, 1999

[54] CHIP CONDITIONER DRIVE

[75] Inventor: Bryan P. Lanham, Gresham, Oreg.

[73] Assignee: Beloit Technologies, Inc., Wilmington, Del.

[21] Appl. No.: 09/144,658

[22] Filed: Sep. 1, 1998

[51] Int. Cl.[6] ..... B02C 4/42

[52] U.S. Cl. ..... 241/227; 241/235; 241/285.1

[58] Field of Search ..... 241/227, 235, 241/236, 221, 285.1

[56] References Cited

U.S. PATENT DOCUMENTS

| | | | |
|---|---|---|---|
| 1,130,365 | 2/1915 | Altheide | 241/143 |
| 3,037,540 | 6/1962 | Bloomquist et al. | 241/282.1 |
| 3,837,490 | 9/1974 | Driebel et al. | 241/178 X |
| 5,385,309 | 1/1995 | Bielagus . | |
| 5,813,617 | 9/1998 | Thoma | 241/135 |
| 5,823,452 | 10/1998 | Ballew et al. | 241/225 |

OTHER PUBLICATIONS

"DynaYield Chip Conditioner™. . . cost effective overthick chip processing" Rader Companies—May 1993.

"Rader DynaYield™II Chip Conditioner"—Beloit Corporation—May 1997.

*Primary Examiner*—John M. Husar

*Attorney, Agent, or Firm*—Raymond W. Campbell; Gerald A. Mathews; Lathorp & Clark LLP

[57] ABSTRACT

A single drive motor is connected by a speed reducer directly to the shaft of one roll of the two aggressive surfaced rolls which form a chip destructuring nip. One roll is dynamically positionable perpendicular to its axis of rotation to open and close the nip. Each roll turns on a shaft positioned along the axis of the roll which is mounted to a frame by bearings. Only the non-positionable roll is driven directly by the drive motor. The roll which is dynamically positionable is driven by a tire arrangement mounted about the axes of the rolls. Opposed tires mounted on the spaced apart parallel shafts form a clutch-like means for driving the dynamically positionable roll.

10 Claims, 2 Drawing Sheets

CHIP CONDITIONER DRIVE

BACKGROUND OF THE INVENTION

The present invention relates to an apparatus for treating wood chips to enhance liquor penetration in subsequent pulping operations. More particularly, the present invention relates to destructuring apparatus in which chips are passed between closely spaced rolls whose surfaces are aggressively contoured for causing chips to be cracked by compressive forces.

In the production of paper from wood fibers, the wood fibers must be freed from the raw wood. In one widely used method, this is accomplished by cooking the wood fibers in a solution until the lignin which holds the fibers together is dissolved. It is desirable to minimize damage to fibers from over cooking. If wood chips of non-uniform thickness are sent to the digester, some chips will be over cooked before thicker chips are completely digested. In order to achieve rapid and uniform digestion by the cooking liquor, the wood, after it has been debarked, is passed through a chipper which reduces the raw wood to chips on the order of one inch to four inches long. The chipper tends to produce a large percentage of over-thick chips which, after separation on a bar screen, must normally be reprocessed through a slicer to reduce them to the desired thickness. This reprocessing through a slicer has the undesirable effect of creating excessive sawdust and pins. The production of sawdust and splinters reduces the overall yield of fibers from a given amount of raw wood. Because the cost of the raw wood is a major contributor to the cost of paper produced, re-slicing the oversized chips incurs a considerable cost.

An alternative to re-slicing over-thick wood chips is a process known as "destructuring" the chips. The chips are fed through opposed rollers which have aggressively contoured surfaces, for example surfaces formed with an array of pyramid-shaped projections. Compressing the chips as they pass through the nip of the rollers produces longitudinal fractures along the grain of the wood. The cracks induced in the chips allow the cooking liquor to penetrate the interior of the chip, thus effectively reducing the chip's thickness. U.S. Pat. Nos. 4,953,795 and 5,385,309, which are hereby incorporated herein by reference, teach the construction of rolls which destructure the wood chips by cracking them preferentially in the direction of the grain.

Improvements in chip destructuring technology which reduce acquisition costs and simplify maintenance and installation would further improve the advantages provided by chip destructuring machines.

SUMMARY OF THE INVENTION

The chip destructuring device of this invention provides for a single drive motor connected by a speed reducer directly to the shaft of one of the two rolls making up the destructuring device. One roll is dynamically positionable to open and close the nip formed between the rolls. The adjustably positionable roll is driven by a clutch mechanism created by tires which run engaged tread to tread. Each roll has a shaft positioned along the axis of the roll, and the rolls are mounted to a frame by bearings which engage the shafts. The frame supports the rolls, the drive motor, and speed reducer. The non-dynamic roll is driven directly through shaft coupling by the electric motor through the speed reducer. The dynamically positionable roll and the shaft on which it is supported are driven by the system of two tires, with one mounted to the shaft of the stationery roll and one mounted to the shaft of the dynamic roll. When the dynamically positionable roll is positioned close to the non-dynamic roll the tire mounted to the shaft of the dynamic roll engages the tire mounted to the static roll, resulting in the dynamic roll being brought up to speed with the rotation of the static roll.

By only driving the static roll directly, a chip destructuring device which requires fewer parts, fewer safety shields, and which eliminates all moving electrical connections is possible.

It is an feature of the present invention to provide a chip destructuring device having a reduced cost.

It is another feature of the present invention to provide a chip destructuring device with lower maintenance.

It is a further feature of the present invention to provide a chip destructuring device which is easier to manufacture and install.

Further objects, features, and advantages of the invention will be apparent from the following detailed description when taken in conjunction with the accompanying drawings.

DESCRIPTION OF THE PREFERRED EMBODIMENT

Figure 1:
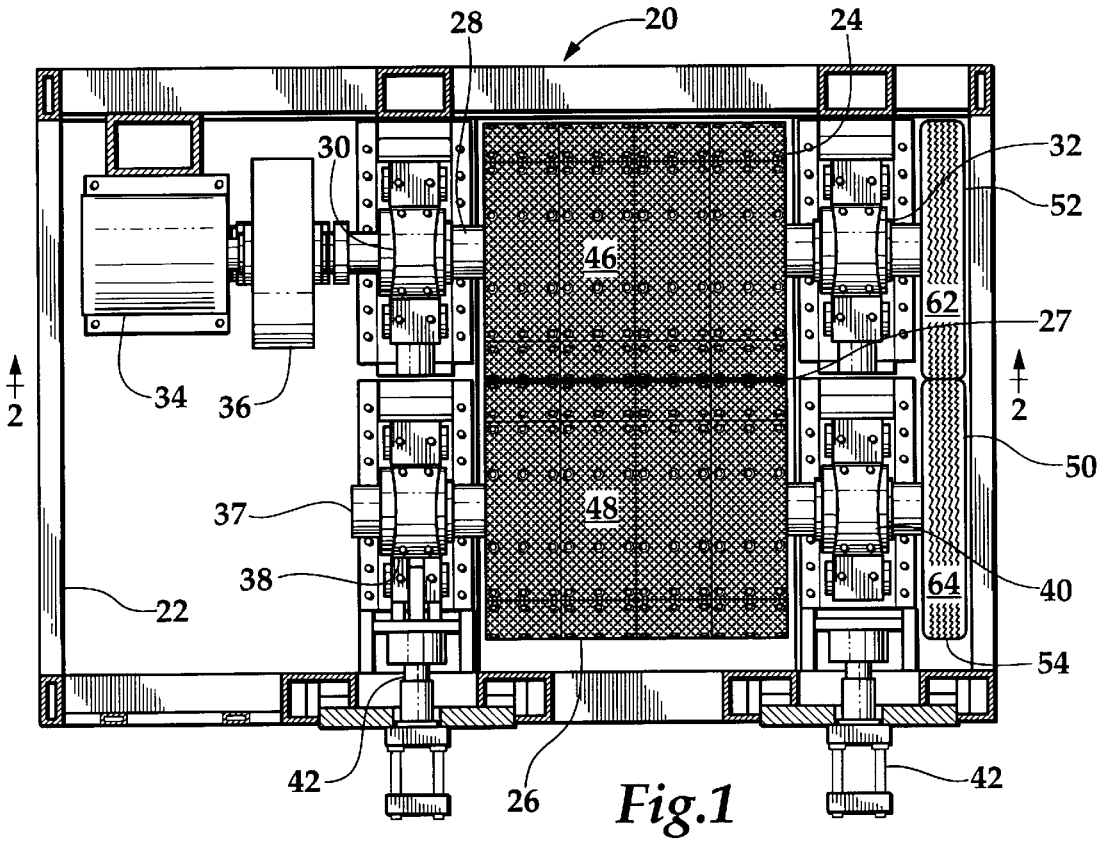
FIG. 1 is a top plan view of the chip destructuring apparatus of this invention.
Figure 2:
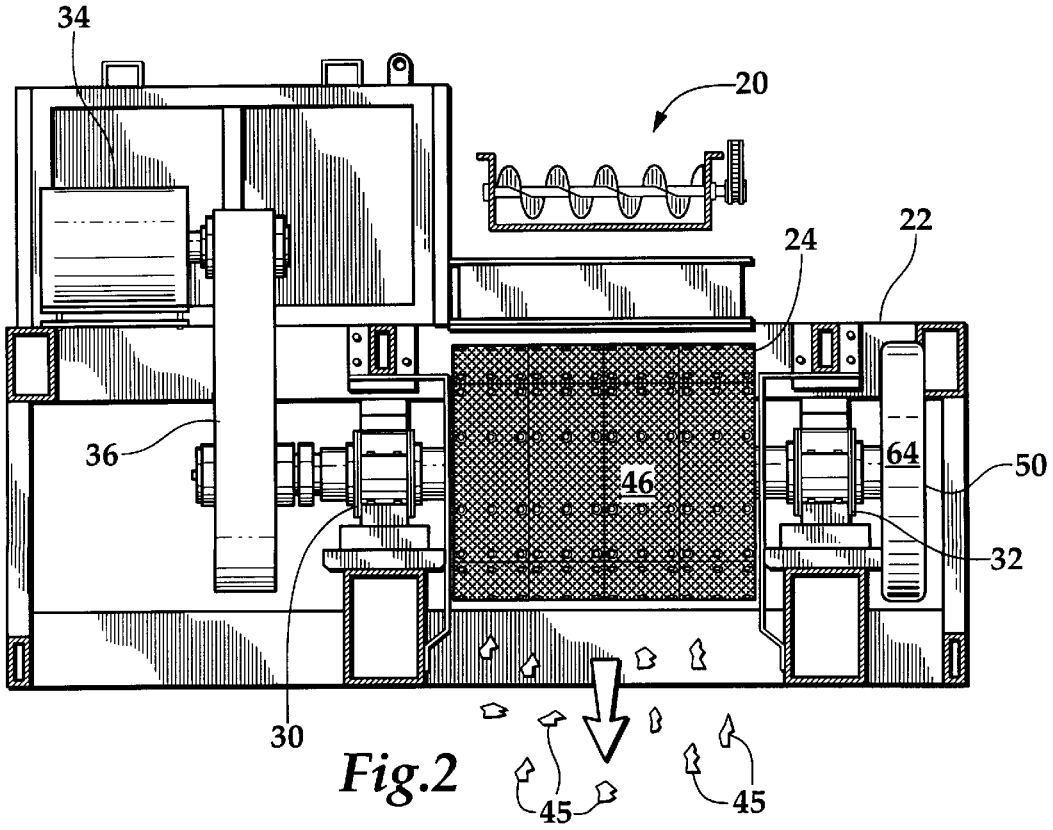
FIG. 2 is a side elevational cross-sectional view of the chip destructuring apparatus of FIG. 1 taken along section lines 2—2.
Figure 3:
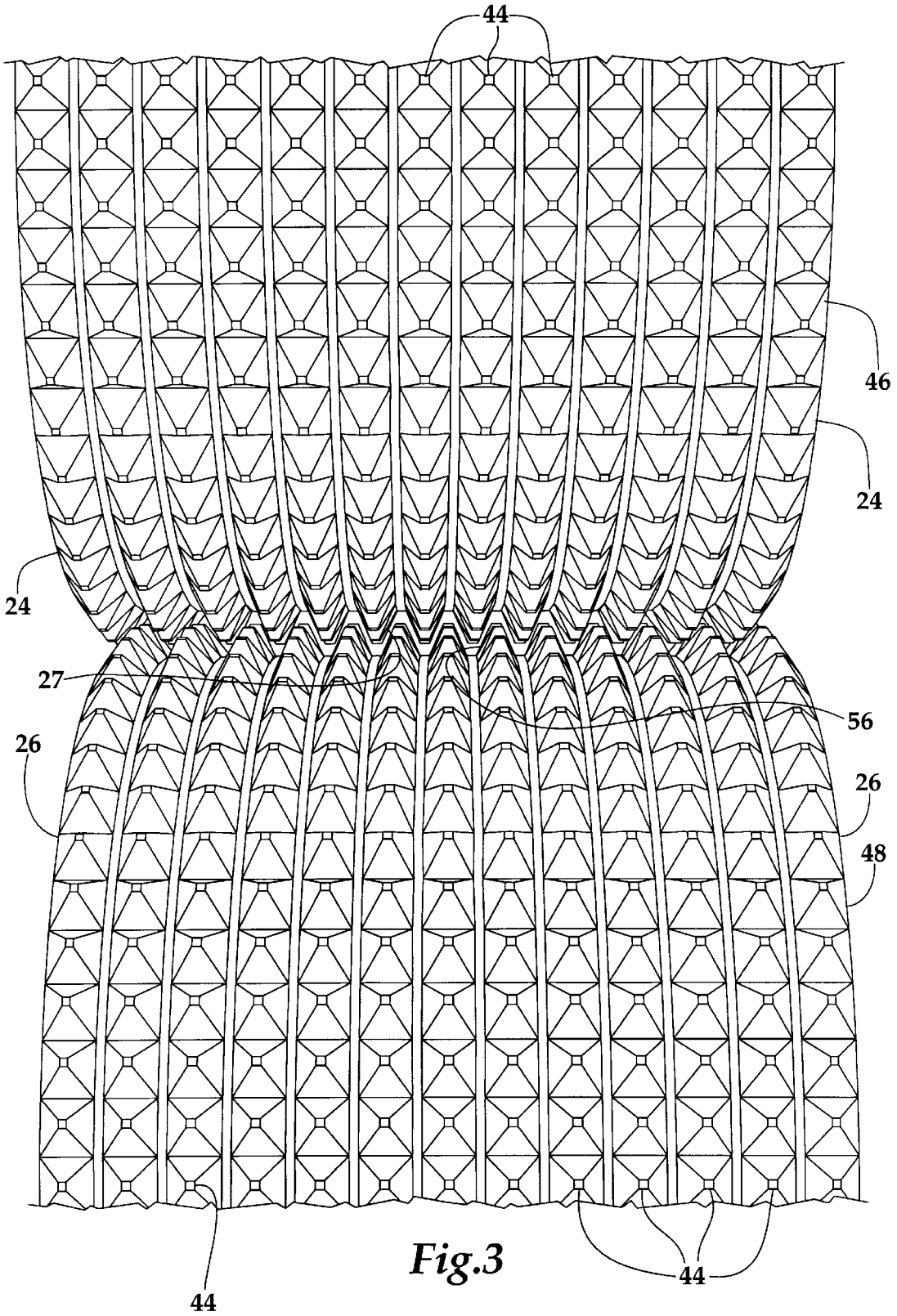
FIG. 3 is an isometric view of the destructuring rolls of the apparatus of FIG. 1 forming a nip.

Referring more particularly to FIGS. 1–3 wherein like numbers refer to similar parts, a chip destructuring apparatus 20 is shown in FIG. 1. The destructuring apparatus 20 has a frame 22 on which a first roll 24, and a second roll 26 are mounted. The first roll is supported on a shaft 28 and the shaft is supported on a drive side bearing 30 and an opposed bearing 32. The bearings 30, 32 which support the first roll are rigidly mounted to the frame. An electric motor 34 is also mounted to the frame and is coupled to a speed reducer 36 which is mounted to the frame and is in driving engagement with the shaft 28 of the first roll 24. Flexible couplings may be placed between the motor 34, and the speed reducer 36, and between the speed reducer and the first roll shaft 28 to accommodate small misalignments between the input and output of the speed reducer 36 and the motor shaft and the roll shaft 28.

Other approaches to mounting the drive motor include mounting it above the speed reducer and connecting it to the speed reducer with a v-belt drive. An inline speed reducer and an inline electric motor wherein the electric motor and the speed reducer are mounted by a bracket which extends from the frame is also possible. A parallel shaft, speed reducer such as those available from Falk Corporation, P.O. Box 492, Milwaukee, Wis. 53201-0492 may be the most cost effective.

In comparison to existing devices of similar size the destructuring apparatus 20 will have a motor driving the first roll 24 which has approximately twice the horsepower of a destructuring device in which both rolls are driven. Because the motor drives only the shaft 28, which does not move laterally on the frame 22, the use of drive belts can be eliminated.

The second roll 26 is mounted on a shaft 37 which is mounted to a first bearing 38 and a second bearing 40. The bearings 38, 40 slidably mount the second roll 26 to the frame 22. Hydraulic actuators 42 mounted between the frame and the bearings 38, 40 control movement of the second roll 26 toward and away from the first roll 24. Where the rolls 24, 26 most closely approach they form a nip 27, as best shown in FIG. 3. Wood chips 45 which pass through the nip 27 are engaged by a series of pyramids 44 which are formed on the surfaces 46, 48 of the rolls 24, 26. As shown in FIG. 2, the pyramids 44 grip and compress wood chips 45 as they pass through the nip 27. The compression of the wood chips 45 results in cracking preferentially along the grain of the wood.

Compressing the wood chips 45 as they pass through the nip 27 requires work to be done. The rate at which work is performed dictates the power required to compress the chips 45. The power necessary to compress the wood chips 45 is supplied by the drive motor 34 which drives the first roll 24 through a speed reducer 36.

The kinematics of a device which uses two opposed rolls to crush material between the rolls is as follows. The surfaces of the opposed rolls approach each other as they rotate through the nip. A particle or object, whether a stone or a wood chip, experiences a crushing force as the object approaches the nip, and because the rolls' sides slope away from the nip, the particle experiences a force away from the nip. Particles can be caused to pass through the nip either by increasing the diameter of the rolls forming the nip, or by increasing the frictional forces engaging the particles/wood chips with the rolls surfaces. For a chip destructuring device the wood chips are driven through the nip by aggressively contoured surfaces which also compress the chips so they crack along the grain of the wood.

Substantially all the work done on the wood chips which pass through the nip is a result of compressing the wood chips. The surface velocity of the rolls times the level of force necessary to crush the wood chips between the rolls equals the horsepower which must be supplied by the drive motor or motors.

If each roll is driven by a motor of identical size then each roll provides half the power necessary to crush the material passing through the nip between the rolls. If one roll is driven and the other is not, then the driven roll provides all power necessary to crush the material moving between the two rolls. The process does not require that power be transferred to the non-driven roll. This can be understood by considering the problem of cracking a nut with two hammers: If the nut is struck from both sides simultaneously by two hammers, both hammers contribute towards the energy necessary to crack the nut. On the other hand if one hammer is fixed to a support and the other hammer is swung with twice the force against the nut all the energy necessary to crack the nut is supplied by the moving hammer.

Another way to view the energy balance involved in crushing a wood chip between two rotating rolls is to consider where the work is applied. The energy which is applied in a chip destructuring device is completely utilized by the wood chips that pass through the destructuring device. If energy is being transferred through the chip all the work required to crush the chip is completed before energy is transfered to the non-driven roll.

Although the non-driven roll 26 does not require any drive power, it must rotate in sync with the driven roll 24 in order that the chips not be subjected to shear forces. The chips 45 passing through the nip 27 will rapidly cause the non-driven roll to accelerate to the angular velocity of the driven roll 24. However the acceleration of the non-driven roll takes place over a very short interval if wood chips are fed into the nip 27 created between the rolls 26, 24. Overly rapid acceleration of the non-driven roll can place high loads on the non-driven roll and its support structure. Therefore a mechanism 50 for gradually accelerating the non-driven roll is required. The mechanism shown in FIGS. 1 and 2 includes a first tire 52 mounted on the driven shaft 28 and a second tire 54 mounted on the non-driven shaft 37. The tires 52, 54 are sized so that they contact as the non-driven roll 26 is brought next to the driven roll 24 to form a nip 27 as shown in FIG. 3. The rolls 24, 26 do not actually touch but form an undulating line 56 where the roll surfaces most closely approach each other. The wood chips pass through this undulating line 56 of closest approach and are compressed and cracked.

The tires 52, 54 can be used to start both rolls while in engagement or to accelerate the non-driven roll 26 by movement of the non-driven roll into juxtaposition with the driven roll so that the tires engage and cause the non-driven roll to turn at the same angular rate as the driven roll 24.

The tires 52, 54 form a clutch mechanism 50 which has two important attributes: the power system does not need to move with the non-driven roll 26 and, at the same time, the power transmitted through the system forms a clutch which allows the direct engagement through a frictional system. Thus the non-driven roll 26 as it approaches the driven roll 24 experiences an acceleration force which can be controlled by how rapidly the non-driven roll approaches the driven roll 24 and has a maximum force governed by the maximum dynamic friction force between the engaging surfaces 62, 64 of the tires 52, 54.

The tires 52, 54 form clutch members which interact through a frictionally physical interaction to cause the non-driven roll 26 to rotate at the same angular rate as the driven roll 24. Thus when wood chips are introduced into the nip 27, a simple crushing action takes place without any significant shear.

The size, air pressure (if they are air filled) of the tires, as well as the coefficient of friction of the tire surfaces 62, 64, can be used to control the dynamics of the engagement between the tires 52, 54.

A frictional physical interaction is defined as the interaction between two rotatable mechanical systems which brings a non-rotating system into dynamic sync with a rotating system and which allows slippage between the two rotatable mechanical systems and employs an energy dissipation mechanism such as friction to limit maximum angular acceleration of the non-rotating system.

It should be understood that wherein the destructuring device 20 is shown with a frame constructed of tubular sections, for ease of manufacture and to take advantage of modern part-layout and computer controlled laser part cutting, the framework may be constructed of welded plate segments. An example of such manufacturing design is shown in "Rader DynaYield TM II Chip Conditioner" Brochure 9703 Printed May, 1997 and distributed by Rader Companies, a Division of Beloit Corporation.

It is understood that the invention is not limited to the particular construction and arrangement of parts herein illustrated and described, but embraces such modified forms thereof as come within the scope of the following claims.

I claim:

1. An apparatus for destructuring wood chips comprising:

a frame;

a first roll mounted to the frame on a first shaft for rotation about a first axis;

a first clutch member mounted on the first shaft;

a second roll mounted to the frame on a second shaft for rotation about an axis parallel to the first axis, wherein the first roll and the second roll are spaced from each other a pre-selected distance for applying compressive force to wood chips passing therebetween, and wherein at least one of said first roll and second roll have portions defining a contoured roll surface formed by a matrix of outwardly extending projections which define an aggressively contoured roll surface, the aggressively contoured roll surface causing wood chips introduced between the first roll and the second roll to be cracked primarily in a direction parallel to the chip fibers as compressive force is applied thereto; and a second clutch member mounted on the second shaft, wherein the second clutch member interacts through a frictionally physical interaction with the first clutch member to cause the first roll and the second roll to rotate at the same angular rate.

2. The apparatus of claim 1 wherein the first and second clutch members are rubber tires which frictionally engage.

3. The apparatus of claim 1 further comprising an electric motor mounted to the frame and a speed reducer mounted between the motor and the first shaft to supply the first shaft with motive power.

4. The apparatus of claim 1 wherein the second roll has an aggressively contoured surface.

5. The apparatus of claim 1 wherein the second roll is mounted for movement toward and away from the first roll.

6. An apparatus for destructuring wood chips comprising:

first and second cylindrical rolls disposed for rotational operation substantially parallel to each other, and spaced from each other over a pre-selected distance for applying compressive force to wood chips passing therebetween;

one and only one of the first and second rolls being connected to an electric motor for rotating; and at least the first roll having an aggressively contoured roll surface including a matrix of outwardly extending discrete projections;

a first clutch member mounted on a first shaft about which the first roll is mounted;

a second clutch member mounted on a second shaft about which the second roll is mounted wherein the second clutch member interacts through a frictional physical interaction with the first clutch member to cause the first roll and the second roll to rotate at the same angular rate.

7. The apparatus of claim 6 wherein the first and second clutch members are rubber tires which frictionally engage.

8. The apparatus of claim 6 further comprising an electric motor mounted to the frame and a speed reducer mounted between the motor and the first shaft to supply the first shaft with motive power.

9. The apparatus of claim 6 wherein the second roll has an aggressively contoured surface.

10. The apparatus of claim 6 wherein the second roll is mounted for movement toward and away from the first roll.

* * * * *